United States Patent [19]

Fauser et al.

[11] Patent Number: 4,580,994

[45] Date of Patent: Apr. 8, 1986

[54] TOY VEHICLE

[75] Inventors: Fritz Fauser, Arlington Heights; Wayne A. Kuna, Oak Park; Steven P. Hanson, Winnetka, all of Ill.

[73] Assignee: Marvin Glass & Associates, Chicago, Ill.

[21] Appl. No.: 561,786

[22] Filed: Dec. 15, 1983

[51] Int. Cl.[4] ..... A63H 17/00

[52] U.S. Cl. ..... 446/465; 446/414; 446/437; 446/461; 446/462

[58] Field of Search ..... 446/448, 457, 461, 462, 446/463, 465, 466, 469, 470, 397, 404, 409, 414, 418, 419, 420, 421, 422

[56] References Cited

U.S. PATENT DOCUMENTS

| | | | |
|---|---|---|---|
| 2,609,640 | 9/1952 | Newell et al. | 446/404 |
| 3,698,129 | 10/1972 | Lemelson | 446/462 |
| 3,702,037 | 11/1972 | Toy et al. | 446/470 |
| 3,875,696 | 4/1975 | Howland | 446/404 |
| 4,059,918 | 11/1977 | Matsushiro | 446/463 |
| 4,094,094 | 6/1978 | Ono | 446/457 |
| 4,183,174 | 1/1980 | Barris et al. | 446/462 |
| 4,245,427 | 1/1981 | Accornero | 446/409 |
| 4,329,810 | 5/1982 | Terui | 446/463 |
| 4,467,556 | 8/1984 | Iwao et al. | 446/470 |
| 4,467,557 | 8/1984 | Kuna et al. | 446/463 |

*Primary Examiner*—Robert A. Hafer
*Assistant Examiner*—Daniel Nolan
*Attorney, Agent, or Firm*—John S. Pacocha

[57] ABSTRACT

A toy vehicle with a two-part, telescoping, chassis is driven by a battery powered motor. The child manipulates a control lever to energize the motor and produce engine revving sounds and then engage the rear wheels to start the vehicle doing a wheelie. One part of the chassis carries the front axle and wheels along with the motor and batteries plus an elongated resonating tube with a bellows and striking rib at one end adjacent the motor and an angular, open, sound producing end. Beaters driven by the motor strike the rib to produce the engine revving sound. Rear wheels mounted on an axle carried by the other part of the chassis are drivingly engaged with the motor when the two parts are telescoped together. The shift control lever is mounted for pivotal movement into an initial electrical circuit completing contact to energize the motor and later mechanical shifting to telescope the rear axle carrying part towards the motor to engage the motor and rear axle. Positioning of the batteries and motor over the rear axle plus the initial thrust of power causes the front end of the vehicle to lift and do a wheelie.

15 Claims, 9 Drawing Figures

TOY VEHICLE

BACKGROUND OF THE INVENTION

1. Field of the Invention

This invention relates generally to toy vehicles and more particularly to self-propelled toy dragsters.

2. Background Art

Toy vehicles, particularly those appearing like or performing like actual racing vehicles, have long been popular children's toys. One type of racing vehicle which is especially attractive to both children and adults because of the intense drama and action that occurs within a relative short span of time is the dragster. In addition to its distinctive appearance, especially in the "Funny Car" class, the sounds of the revving engine and the wheelies oftentimes performed at the start are features that readily distinguish the dragster. Prior art toy vehicles such as the ones disclosed in U.S. Pat. Nos. 3,160,984; 3,190,034; 3,236,008; 3,286,393; and 3,735,529 have included engine sound features, while others such as those disclosed in U.S. Pat. Nos. 3,702,037; 3,757,459; and 4,329,810 have provided wheelie performance. There remains, however, a need for a toy vehicle, particularly a self-propelled vehicle, that will emulate the periodic deep roaring sounds of the dragster engine as it prepares to leave the starting line and will start off with a wheelie upon transmission of full power to the driven wheels.

SUMMARY OF THE INVENTION

The present invention is concerned with providing a self-propelled toy vehicle that enables play simulating the periodic deep roaring sound of a dragster engine revving up with a wheelie takeoff from the starting line. These and other objects and advantages are achieved by a motor driven vehicle in which the chassis has first and second parts mounted for telescoping movement between first and second positions to move the motor mounted on the first part into position for transmitting power to a wheel on an axle mounted on the second part. Movement of the parts is effected by a control lever that is pivotal from a first to a second orientation with the lever also functioning to complete an electrical circuit between batteries and the motor when the lever is moved out of the first orientation. As soon as the motor is energized, it drives beater elements which strike a projecting rib on the end of a bellows portion of an elongated resonant tube. However, power is not transmitted to the driven wheels until the lever is moved to the second orientation. Thus, the lever may be pivoted back and forth from the first orientation to just short of the second orientation to alternately energize and de-energize the motor. The on and off switching produces a cycling engine revving sound that comes out of an angled opening at the other end of the tube as a deep roaring sound. When the lever is moved into the second orientation, the full power of the engine is transmitted to the driven wheel. At the same time, the center of gravity is shifted over the rear axle so that the additional force resulting from the sudden engagement of the motor rotates the center of gravity to lift the front wheels off the surface. Once the vehicle stops accelerating, the center of gravity shifts back toward the front enough for the front wheels to again touch the surface.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
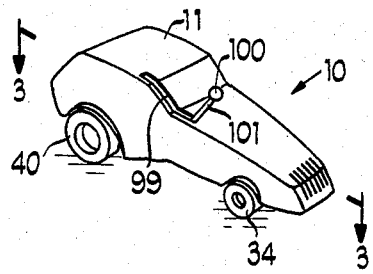
FIG. 1 is a perspective view of a toy vehicle embodying the present invention.
Figure 2:
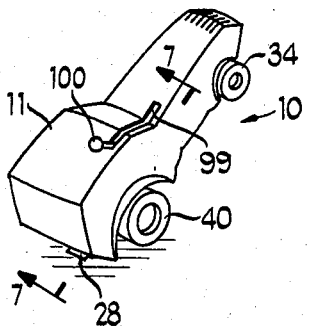
FIG. 2 is a perspective view of the toy vehicle doing a wheelie.

Referring now to the drawings in which like parts are designated by like reference characters throughout the several views, there is shown a toy dragster vehicle 10 embodying the present invention. The vehicle has a body 11 atop an elongated telescoping chassis 12 consisting of a first or front part 14 and a rear or second part 16.

Figure 3:
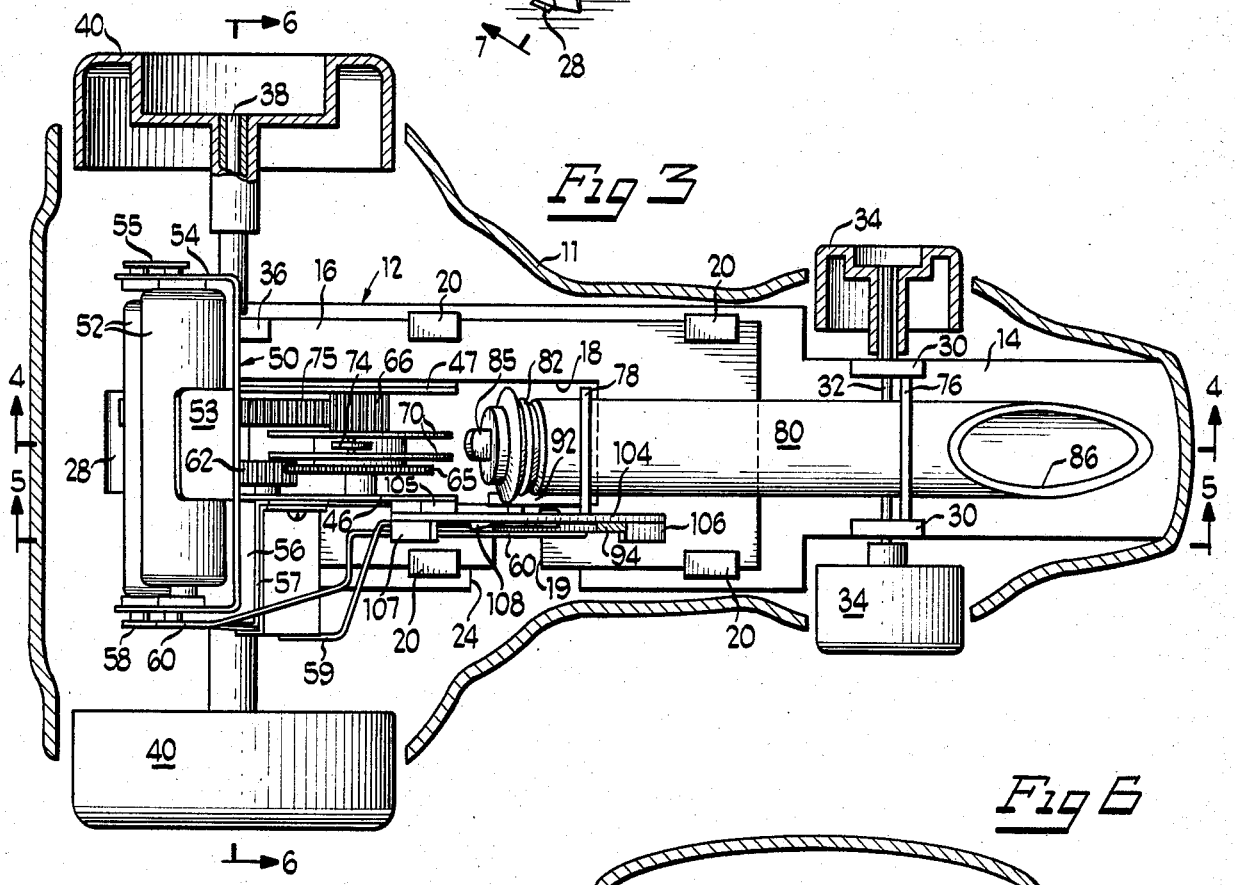
FIG. 3 is an enlarged scale, sectional view taken generally along the line 3—3 of FIG. 1.
Figure 8:
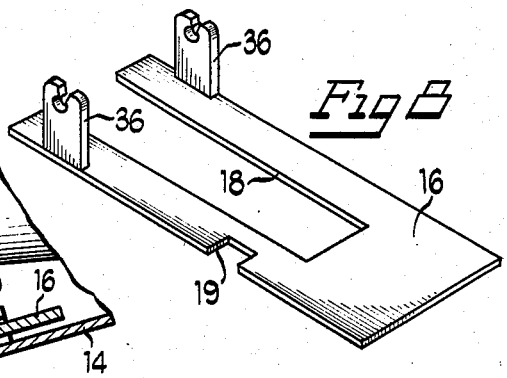
FIG. 8 is an enlarged scale perspective view of one part of the chassis.

Front part 14 is essentially a flat rectangular piece of plastic or stamped metal which may have a narrower portion near the front as is best shown in FIG. 3 to accommodate a shorter front axle and narrower front vehicle body 11 as are found in some styles of racing vehicles. Rear part 16 is similarly formed of plastic or stamped metal and also has a generally rectangular outline as is best shown in FIG. 8. There is an open cutout portion 18 of the rear part 16 that extends through about two-thirds of the rearward portion of part 16. In addition, the rear part 16 includes a notch 19 in one side.

Generally opposed pairs of right angle pieces 20 are secured at intervals along the top sides of the front part 14 defining channels 22 for receiving the rear part or tongue 16 for reciprocal sliding movement atop part 14. Front part 14 also includes a notch 24 in one side. The notch 24 is substantially longer than the notch 19 in the rear part 16. A slot 26 extends through the front part 14 adjacent the back end and a skid 28 depends downwardly at an angle from the back end.

A pair of attached or integrally formed front axle trunnion supports 30 along either side of the reduced width forward portion of front part 14 receive the front axle 32 with front wheels 34 for rotation relative to the chassis 12. Similarly, rear part 16 has spaced apart trunnion supports 36 for the rear axle 38 with wheels 40 mounted for rotation relative to the chassis 12. Both the front wheels 34 and the rear wheels 40 may be molded of plastic or rubber and are attached to the respective axle for rotation with the axle which is rotatably supported in the respective trunnions. In keeping with the style of racing vehicle shown and described in this preferred embodiment, the front wheels 34 are not only carried on a shorter axle but are also of a smaller diameter than the rear wheels 40.

Figure 4:
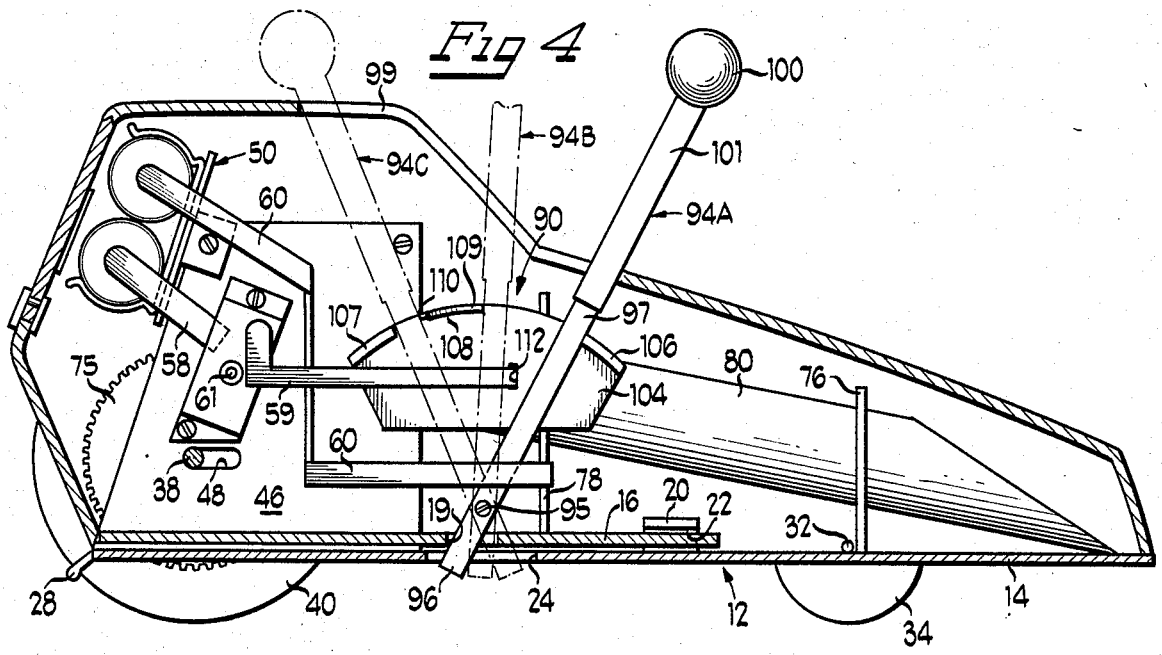
FIG. 4 is a sectional view taken generally along the line 4—4 of FIG. 3.
Figure 5:
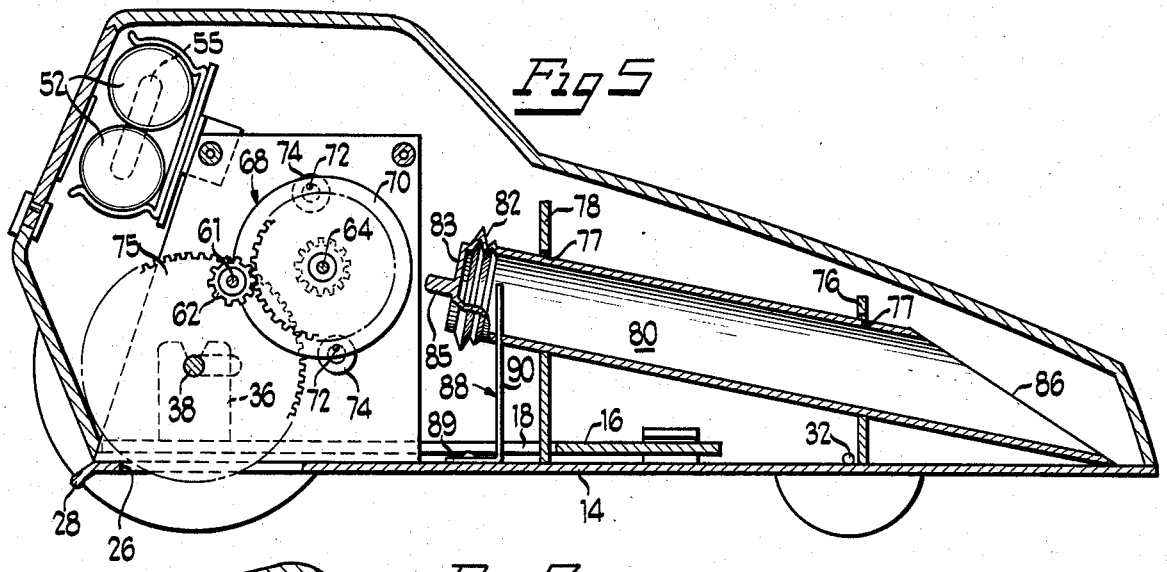
FIG. 5 is a sectional view taken generally along the line 5—5 of FIG. 3.
Figure 7:
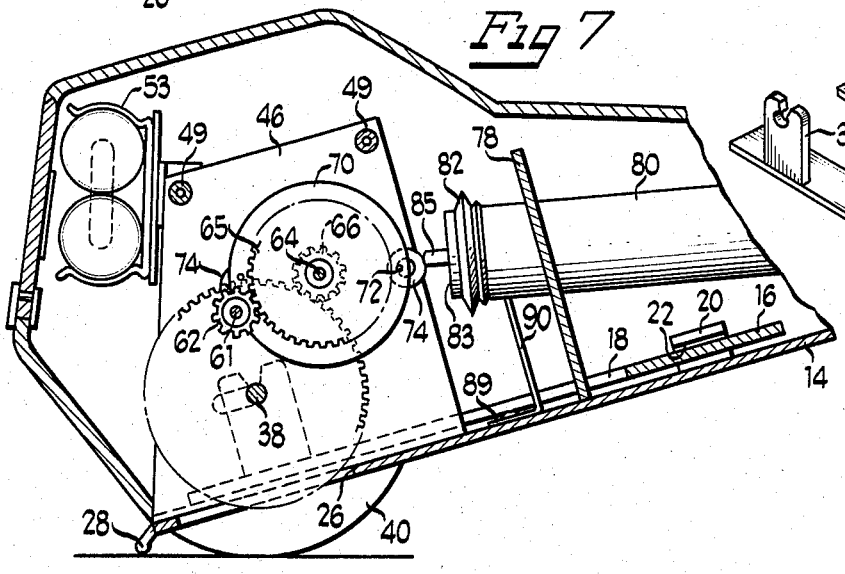
FIG. 7 is an enlarged scale, fragmentary, sectional view taken generally along the line 7—7 of FIG. 2.

Attached to, or integrally formed with, the front or first part 14 are a pair of "L" shaped power mount plates 42 and 43. The horizontal legs 44 and 45 are disposed outwardly on top of chassis part 14 such that vertical legs 46 and 47 are spaced apart in a substantially parallel relationship. Each vertical leg 46 and 47 has an elongated substantially horizontal slot 48 through which the rear axle 38 extends and may be shifted back and forth. Upper spacing fasteners 49 maintain the spaced parallel relationship of the vertical portions 46 and 47. As shown in FIGS. 4, 5 and 7, the vertical portions have a trapezoidal shape although they could be rectangular or triangular.

Secured near the top of the angled back edge of the power mounts 42 and 43 is a bracket 50 for two AA penlight batteries 52. Bracket 50 includes a "C" shaped spring clip 53 and a transverse "U" shaped retainer 54 for receiving the two penlight batteries in reverse order so that they may be connected in series through contact strip 55. A small DC electric motor 56 is mounted on the outside of the "L" shaped power mount 42 by means of strap 57. Between the batteries 52 and the motor 56 there is a short electrical contact strip 58. Extending from the motor 56 is a contact strip 59 and another contact strip 60 extends from the batteries 52. However, the contact strips 59 and 60 are spaced out of electrical contact leaving the battery-motor circuit open.

Output shaft 61 of the motor 56 extends through the vertical leg 46 to rotate motor output pinion 62. A shaft 64 is journaled for rotation between the two spaced vertical portions 46 and 47. Mounted for concentric rotation with the shaft 64 is spur gear 65 and drive pinion 66. Also mounted on shaft 64, for rotation with the shaft, is a beater 68 that is conveniently disposed between the gears 65 and 66.

Beater 68 comprises a pair of spaced side discs 70 between which extend a pair of diametrically opposed peripheral pins 72 each carrying an annular ring or washer 74. The diameter of the center opening in each ring 74 is substantially greater than the diameter of each of the pins 72. Accordingly, as the shaft 64 is driven by the motor 56 through the engagement of the output pinion 62 with the spur gear 65, centrifugal force moves each of the rings 74 to the outer extended position as is illustrated in FIG. 7.

Figure 6:
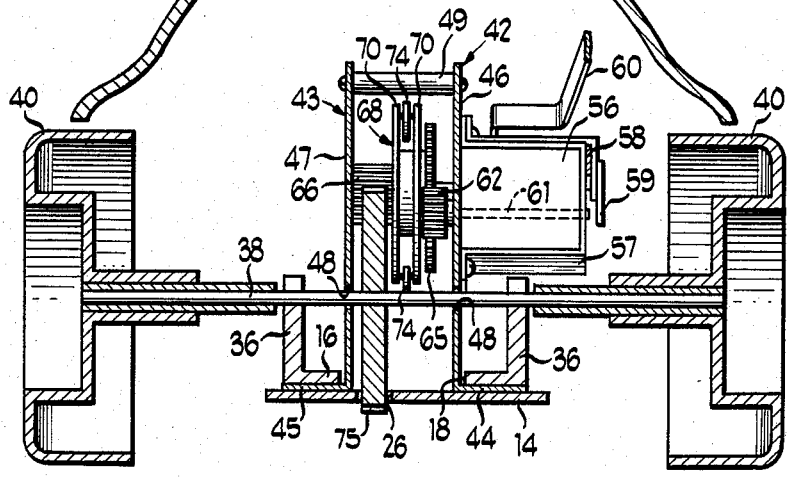
FIG. 6 is a sectional view taken generally along the line 6—6 of FIG. 3.

Drive gear 75 is secured to the rear axle 38 for rotation with the rear axle and the rear wheels 40. As is best shown in FIGS. 5, 6 and 7, a portion of the drive gear 75 protrudes through the open cutout 18 of the rear part 16 and slot 26 in the front part 14. Without such protrusion of the drive gear 75, it would be necessary to either use a smaller drive gear which would reduce the torque to the rear axle or require greater spacing between the bottom of the chassis 12 and the play surface which would detract from the dragster styling.

Extending between the front axle supports 30 is a forward strut 76 having a generally circular opening 77. Also supported on the front part 14, spaced from strut 76, is a rearward strut 78 that also has a generally circular opening 77. The opening in strut 78 is higher relative to the front part 14 than is the opening in strut 76. An elongated tubular resonator 80 projects through, and is supported in, the generally circular openings 77.

The back end of the tube projecting rearwardly of the strut 78 is sealed off by an axially compressible bellows 82 having a transverse diaphragm end 83. A ridge or rib 85 extends rearwardly beyond the diaphragm 83 toward the beater 68. At the forward sounding end 86, tube 80 is open and cut in a plane forming an acute angle with the axis or elongated dimension of the tube. All of tube 80, including the bellows 82, diaphragm 83 and projecting rib 85, may be integrally molded of a plastic material. Tube 80 is elongated in the axial dimension about seven times the diameter. An "L" shaped post 88 is secured through its lower leg 89 to the front part 14 and the upper vertical leg 90 extends through one wall of tube 80 to help secure the tube against displacement in the axial or elongated dimension.

As illustrated in FIG. 7, when the motor 56 is energized, beater 68 is driven in a counterclockwise direction with the rings 74 centrifugally extended such that the rings strike the projecting rib 85 on the sound tube 80. Since the ring 74 is permitted to move inwardly upon the pin 72, the beater 68 absorbs some of the impact of the rings upon the rib 85. However, each blow of the revolving ring 74 upon the rib 85 is transmitted through the bellows and the elongated sound tube out of the open sounding end 86 producing a relatively loud, deep throaty staccato sound that simulates the revving of internal combustion engines of the type used in racing vehicles.

Figure 9:
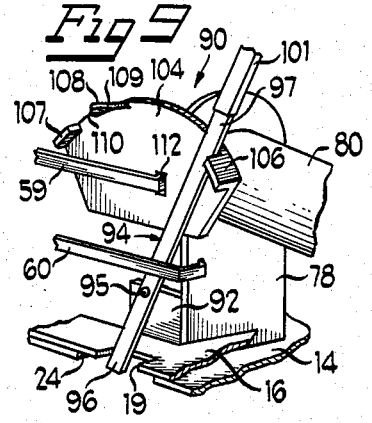
FIG. 9 is an enlarged scale, fragmentary perspective view showing part of the control mechanism.

Mounted on one side of the front part 14, outboard of, and partially supported by, each of the rearward strut 78 and the vertical leg 46 is a power, sound and drive control 90 which is best illustrated in FIGS. 4 and 9. Extending upwardly from the part 14 is a post 92 which may be integrally molded or a separately secured piece. Post 92 is also attached to the rearward strut 78 for additional support.

Electrically conductive metal lever 94 is supported on post 92 for pivotal movement about fulcrum pin 95 which divides the lever 94 into a lower load arm 96 and an upper effort arm 97. The effort arm 97 is approximately six times longer than the load arm 96 to provide sufficient mechanical advantage for the mechanical work to be done by the lever 94. A smaller effort arm to load arm ratio may be used. The upper or effort arm of the lever projects outwardly of the vehicle body 11 through a slot 99. On the free end of the arm 97 is a knob 100 made of an electrical insulating material. An insulating sleeve 101 extends down from the knob such that all of the metal lever 94 projecting beyond the body 11 is insulated.

Inboard of the lever 94 is a vertically situated arcuate sector control plate 104 mounted on vertical leg 46 and strut 78. A spacer 105 separates the leg 46 and the plate 104. Lever 94 is essentially in sliding contact with the face of the sector 104. Outwardly projecting stop tabs 106 and 107 at the upper ends of the sector establish predetermined limits on the distance of pivotal movement of the lever 94. Adjacent the rearward stop 107 is a cam projection 108 which has a gently sloping forward surface 109 and a rather steep rear surface 110. The space between the rearward stop tab 107 and the rearward face 110 of the cam 108 is roughly equivalent to the width of the effort arm 97. Accordingly, the lever 94 is retained in the rearwardmost orientation between tab 107 and cam 108 unless a positive effort is applied to move it out of that rearward orientation.

Contact strip 59 from the motor extends across approximately two-thirds of the segment 104 from the rearward end to forward of center. The free end of the strip 59 is bent at a right angle, inserted through slot 112 in the plate 104, and then secured by again forming a right angle bend at the end. Strip 59 is thus in electrical wiping contact with the exposed metal section of the lever 94 throughout about the latter two-thirds of the distance the lever 94 may be moved. In addition, contact strip 60 extending from the batteries 52 is in constant electrical wiping contact with a lower section of lever 94. A substantially horizontal portion of strip 60 extends outboard of the lever 94 and is biased into electrical contact with the exposed metal of the lever 94 regardless of the pivotal orientation of the lever. The end of the strip 60 is secured to the strut 78 in a manner similar to the securing of the end of strip 59 to plate 104.

In the forwardmost orientation as shown by lever 94A in solid lines in FIG. 4, the electrical circuit remains open and the motor is off. However, in between an intermediate orientation such as is illustrated by the FIG. 4 phantom showing of lever 94B and the rearwardmost orientation illustrated by phantom lever 94C, the battery-motor circuit is closed and the motor is energized. Accordingly, a child may grasp the knob 100 and manipulate the lever 94 from the forwardmost orientation anywhere up to the rearwardmost orientation and energize the motor 56 to drive the beater 68 producing the throaty staccato revving sound out of tube 80 without engaging the drive to the rear wheels 40.

Even if the control lever 94 is not pivoted out of circuit making contact, there will be a cycling of the sound produced by the beater rings 74 impacting the rib 85. Such impacting will compress the bellows 82 a sufficient amount so that the amplitude of the sound produced is decreased. However, the bellows will then recover and the sound will recycle to a loud peak.

As the effort arm 97 is moved from the forward orientation to the rearward orientation, the load arm 96 initially moves freely across the notch 19. However, as the effort arm 97 moves over the forward surface 109 of the cam 108 and drops into the space between the cam 108 and the rear stop 107, the forward lower edge of the load arm 96 engages the forward edge of the notch 19 and shifts or pushes the upper rear part 16 forwardly atop the horizontal legs 44 and 45 and the lower front part 14. Notch 24 in the lower part is large enough to freely accommodate the entire pivotal movement of the bottom end of load arm 96. The forward shifting of the part 16 carries the rear axle 38 supported for rotation in the trunnions 36 together with the drive gear 75 into engagement with the drive pinion 66. Horizontal slots 48 in the vertical portions 46 and 47 allow the lateral movement of the rear axle 38.

Upon the gears 66 and 75 meshing into engagement, torque, multiplied through the gear train, is immediately transmitted from the motor to the driven rear wheels 40. This immediate transfer of angular momentum rotates the center of gravity sufficiently beyond the rear axle 38 to cause the front wheels 34 to lift off the surface upon which the vehicle is resting. Eventually the skid 28 contacts the surface to limit the rearward extent of the wheelie performed by the vehicle.

After the forward shifting of the axle 38 displaces the center of gravity rearwardly and the transmission of the initial drive torque causes the vehicle to do a wheelie, the vehicle will ride for a period of time on the larger diameter rear wheels 40. However, since even the rearwardly displaced center of gravity is close to the vertical center of the rear axle, a decrease in the angular momentum, assisted somewhat by the friction of the skid 28 contacting the surface, will return the vehicle 10 to a level position with the freewheeling front wheels 34 also contacting the playing surface and continue in a forward direction.

While a particular embodiment of this invention has been described and shown, it will be appreciated by those skilled in the art that various modifications and changes may be made without departing from the true spirit of the invention. It is intended in the appended claims to cover all such changes and modifications as fall within the true spirit and scope of the present invention.

What is claimed as new and desired to be secured by Letters Patent is:

1. A toy vehicle comprising:

a chassis having first and second parts mounted for relative reciprocal movement between first and second positions;

a first axle with at least one wheel mounted on the first part for rotation of the wheel relative to the chassis;

a second axle with at least one driven wheel mounted on the second part for rotation of the driven wheel relative to the chassis;

a motor mounted on the first part for transmitting power to the driven wheel when the first and second parts are moved from the first to the second position;

control means effecting the relative reciprocal movement and selectively placing the first and second parts in the first and second positions;

the control means including a mechanical lever that is movable between a first orientation and a second orientation for effecting the relative reciprocal movement of the first and second parts;

the motor being electric and powered by a battery carried by the vehicle;

a first electrical contact extending between the battery and the motor;

a second electrical contact extending from the battery;

a third electrical contact extending to the motor; and the lever having an electrically conductive portion that is extendable across the second and third contacts for completing an electrical circuit between the battery and the motor when the lever is moved from the first to the second orientation.

2. The toy vehicle of claim 1 in which:

the lever is movable through a predetermined distance between the first and second orientations; and the circuit between the battery and the motor is completed in the second orientation and in at least one-half of the predetermined distance immediately preceding the second orientation.

3. The toy vehicle of claim 2 including:

a control plate secured to the chassis;

stop tabs on the control plate defining the predetermined distance; and a projecting cam in proximity to one of the stop tabs for retaining the lever in the second orientation.

4. The toy vehicle of claim 2 including:

a resonator mounted on the chassis; and elements driven by the motor impacting the resonator to produce sound.

5. A toy vehicle comprising:

a chassis having first and second parts mounted for relative reciprocal movement between first and second positions;

a first axle with at least one wheel mounted on the first part for rotation of the wheel relative to the chassis;

a second axle with at least one driven wheel mounted on the second part for rotation of the driven wheel relative to the chassis;

a motor mounted on the first part of transmitting power to the driven wheel when the first and second parts are moved from the first to the second position;

control means effecting the relative reciprocal movement and selectively placing the first and second parts in the first and second positions;

an elongated resonating tube mounted on the chassis;

the tube having a striking end and an opposed sounding end; and elements driven by the motor adapted to impact the striking end of the tube to produce sound from the sounding end.

6. A toy vehicle comprising:

a chassis;

wheels mounted on the chassis for rotation relative to the chassis;

a motor carried by the chassis for transmitting power to at least one of the wheels;

a control lever mounted for pivotal movement relative to the chassis between a first and second orientation;

movement of the lever starting the motor and effecting the transmission of power from the motor to at least one of the wheels;

an elongated resonating tube mounted on the chassis;

the tube having a striking end and an opposed sounding end;

the tube having a corrugated bellows portion compressible in the elongated dimension adjacent the striking end; and elements driven by the motor adapted to impact the striking end of the tube to produce sound from the sounding end.

7. The toy vehicle of claim 6 in which:

the tube has a circular cylindrical body; and the elongated dimension is transverse to and at least twice the diameter of the tube.

8. The toy vehicle of claim 7 in which the elongated dimension along the axis is at least four times the diameter of the tube.

9. The toy vehicle of claim 6 in which the sounding end is cut in a plane forming an acute angle with the elongated dimension of the tube.

10. The toy vehicle of claim 6 in which the striking end has an external projecting rib and the elements are driven by the motor in a path transverse to the rib.

11. The toy vehicle of claim 6 in which:

the motor is electric and powered by a battery carried by the vehicle; and the lever has an electrically conductive portion and movement of the lever out of the first orientation toward the second orientation completes an electrical circuit to energize the motor.

12. The toy vehicle of claim 11 in which movement of the lever into the second orientation mechanically effects transmission of power to at least one of the wheels.

13. A toy vehicle comprising:

a chassis;

wheels mounted on the chassis for rotation relative to the chassis;

a motor carried by the chassis for transmitting power to at least one of the wheels;

an elongated resonating tube mounted on the chassis;

the tube having a striking end and an opposed sounding end;

an external projecting rib on the striking end;

a corrugated bellows portion of the tube adjacent the striking end; and elements driven by the motor adapted to impact the projecting rib to produce sound from the sounding end.

14. The toy vehicle of claim 13 in which:

the motor is electric and powered by a battery carried by the vehicle; and the lever has an electrically conductive portion and movement of the lever out of the first orientation toward the second orientation completes an electrical circuit to energize the motor.

15. The toy vehicle of claim 14 in which movement of the lever into the second orientation mechanically effects transmission of power to at least one of the wheels.

* * * * *